US007824605B2

(12) United States Patent
Lemke et al.

(10) Patent No.: US 7,824,605 B2
(45) Date of Patent: Nov. 2, 2010

(54) AS-CAST CARBIDIC DUCTILE IRON

(75) Inventors: Jeffrey Paul Lemke, Fairfield, IA (US); Robert Edward Eppich, Seven Hills, OH (US)

(73) Assignee: Dexter Foundry, Inc., Fairfield, IA (US)

( * ) Notice: Subject to any disclaimer, the term of this patent is extended or adjusted under 35 U.S.C. 154(b) by 269 days.

(21) Appl. No.: 11/640,003

(22) Filed: Dec. 15, 2006

(65) Prior Publication Data

US 2008/0145645 A1 Jun. 19, 2008

(51) Int. Cl.
*C22C 33/08* (2006.01)
*C22C 37/04* (2006.01)

(52) U.S. Cl. ..... 420/26; 420/15; 420/16; 420/17; 420/18; 420/27; 420/29; 420/30; 420/32; 420/33; 148/321; 148/618

(58) Field of Classification Search ..... 148/321–324, 148/612–618; 420/13–33
See application file for complete search history.

(56) References Cited

U.S. PATENT DOCUMENTS

| | | | | | |
|---|---|---|---|---|---|
| 3,155,498 | A | * | 11/1964 | Jandras | 148/543 |
| 3,784,416 | A | | 1/1974 | Davies | |
| 4,088,476 | A | | 5/1978 | Takao et al. | |
| 4,236,944 | A | * | 12/1980 | Yaman et al. | 148/322 |
| 4,363,661 | A | | 12/1982 | Kovacs | |
| 4,638,847 | A | | 1/1987 | Day | |
| 4,869,328 | A | * | 9/1989 | Carroll | 172/719 |
| 4,870,931 | A | | 10/1989 | Nakamura et al. | |
| 5,113,924 | A | | 5/1992 | Green et al. | |
| 6,258,180 | B1 | | 7/2001 | Wilde et al. | |
| 6,716,291 | B1 | | 4/2004 | Woods | |

FOREIGN PATENT DOCUMENTS

| | | | |
|---|---|---|---|
| GB | 2 265 154 | A | 9/1993 |
| JP | 53 134720 | A | 11/1978 |
| JP | 53 134723 | A | 11/1978 |
| JP | 357194240 | * | 11/1982 |
| JP | 359023844 | * | 2/1984 |
| JP | 2001-220640 | * | 8/2001 |
| JP | 2004-099923 | * | 4/2004 |
| WO | WO 99/19525 | | 4/1999 |
| WO | WO 2004/022491 | A1 | 3/2004 |
| WO | WO 2006/068487 | A1 | 6/2006 |
| WO | WO 2006/072663 | A2 | 7/2006 |

(Continued)

OTHER PUBLICATIONS

Computer-generated English translation of Japanese patent 2001-220640, Ueda, Seishin, Aug. 2001.*

(Continued)

*Primary Examiner*—Deborah Yee
(74) *Attorney, Agent, or Firm*—McKee, Voorhees & Sease, P.L.C.

(57) ABSTRACT

An as-cast carbidic ductile iron is provided, having a pearlitic matrix with 5-50% by volume carbides and high wear resistance properties. The as-cast carbidic ductile iron is produced without an austempering heat treatment step. The as-cast carbidic ductile iron preferably includes a carbide stabilizing element and a spheroidizing agent.

21 Claims, 1 Drawing Sheet

FOREIGN PATENT DOCUMENTS

WO WO 2006/133355 A2 12/2006

OTHER PUBLICATIONS

Derwent publication 1997-452708, the English abstract of Japanese patent 09206915, Asano et al., Aug. 12, 1997.*

Machine-English Translation of Japanese patent 57-194240, Masumi Kawahara et al., Nov. 29, 1982.*

"Ductile Iron Handbook" published by The American Foundrymen's Society, Inc. (copyright 1992) pp. 156-165.

Hayrynen, K.L, et al., "Carbidic Austempered Ductile Iron (CADI)—The New Wear Material", 2003 published in Transactions of the American Foundry Society V 111 Paper No. 03-088 pp. 845-850.

Keough, John R. PE , et al., Carbidic Austempered Ductile Iron (CADI), Nov. 14, 2000, Applied Process, Inc. Technologies Div., 5 pages.

International Search Report, The Dexter Company, PCT/US2007/080405, filed Apr. 10, 2007, 4 pages.

Ametek, Newage Testing Instruments, "Brinell Hardness Testing", http://www.hardnesstesters.com/Applications/Brinell-Hardness-Testing.aspx (2 pages), 2010.

Woodco USA "Oilfield Glossary: Terms and Definitions Related to Hardness", http://www.woodcousa.com/Hardness-defs.htm#Brinell%20Hardness (4 pages), Jul. 2, 2010.

* cited by examiner

AS-CAST CARBIDIC DUCTILE IRON

FIELD OF THE INVENTION

This invention relates to as-cast carbidic ductile iron compositions and to methods for making the same.

BACKGROUND OF THE INVENTION

Conventional cast iron is a ferrous alloy containing carbon. Cast irons are classified according to the shape of the carbon in the iron, also known as graphite morphology. The precipitated graphite in grey cast iron, the first developed and widely used cast iron, is in the shape of flakes. Grey cast iron has, however, some disadvantages such as a low tensile strength and low ductility.

Ductile iron, otherwise known as nodular iron, has a higher strength and ductility than normal grey cast iron. A spheroidizing agent, typically magnesium, cerium, or a combination of magnesium and cerium, is added to the iron which causes the precipitated graphite to form into a spherical shape instead of the irregularly shaped flakes of grey iron. These spheres, or nodules, give ductile iron its increased strength and ductility versus normal grey iron.

Ductile iron is classified into different grades based on the mechanical properties of the iron, such as tensile strength, yield strength, percent elongation, and hardness of the iron. The mechanical properties of ductile iron may be varied by controlling the matrix structure of the iron. For example, normal as-cast ductile iron consists of graphite nodules in a matrix of ferrite and pearlite, with a small amount of carbide as an undesirable constituent. Conventionally, the presence of carbides has been considered to be detrimental to as-cast ductile iron, and accordingly, as-cast ductile iron traditionally is produced with a limited amount of carbides. It is common for the maximum amount of carbide in as-cast ductile iron to be as low as 3%. Carbides have traditionally been disfavored in as-cast ductile irons because it was believed that they make the iron brittle.

Heat treatment has traditionally been used to change the matrix structure of the iron. Conventional heat treatments include normalizing and tempering, oil quenching and tempering, and austempering. Austempering has increasingly become a popular form of heat treating ductile iron. Austempering consists usually of heating the iron casting to approximately 1600-1700° F. and then holding the iron casting for sufficient time to allow the microstructure to homogenize. After the holding period, the casting is submerged and held in a medium at a lower, but still elevated temperature of 400-750° F. After the second holding period, the casting is cooled to room temperature. The austempering heat treatment transforms the microstructure of the ductile iron and reduces the carbide content. After the austempering treatment, the microstructure of the austempered ductile iron consists of graphite nodules in a matrix of ausferrite. Carbidic austempered ductile iron, used in high wear applications, contains more carbides than normal austempered ductile iron and has a matrix structure of ausferrite, high carbon retained austenite and 10-40% carbides.

While austempering increases the strength of the iron, it also adds increased time and expense to the casting process. Many iron applications require high wear resistance but do not necessarily require the increased strength provided by austempering. Thus, a need in the art exists for an iron with adequate wear and toughness properties which is more time and cost effective than austempered iron.

A general object of the present invention is the provision of an as-cast carbidic ductile iron manufactured without an austempering step.

A further object of the present invention is the provision of an as-cast carbidic ductile iron which has high abrasion wear resistance.

A still further object of the present invention is the provision of an as-cast carbidic ductile iron which has high sliding wear resistance.

A still further object of the present invention is the provision of an as-cast carbidic ductile iron which has a high toughness property.

A still further object of the present invention is the provision of an as-cast carbidic ductile iron which has a high hardness property.

A still further object of the present invention is the provision of an as-cast carbidic ductile iron which adequately balances strength, toughness, and wear resistance properties.

A still further object of the present invention is the provision of an as-cast carbidic ductile iron which provides high abrasion and sliding wear resistance properties at a lower cost than alternative materials.

A still further object of the present invention is the provision of an as-cast carbidic ductile iron which provides high toughness and hardness properties at a lower cost than alternative materials.

A still further object of the present invention is the provision of an as-cast ductile iron which provides high abrasion and sliding wear resistance properties and which requires less time to manufacture than alternative materials.

A still further object of the present invention is the provision of a method for making an as-cast ductile iron with a higher percentage of carbides than prior as-cast ductile irons.

A still further object of the present invention is the provision of a method for making a ductile iron with high abrasion, sliding wear resistance, hardness, and toughness properties which does not require an austempering step.

A still further object of the present invention is an object manufactured from as-cast carbidic ductile iron.

A still further object of the present invention is a plow point manufactured from as-cast carbidic ductile iron.

These as well as other objects, features and advantages of the present invention will become apparent from the following specification and claims.

SUMMARY OF THE INVENTION

According to one aspect of the present invention, an as-cast carbidic ductile iron is provided. The as-cast carbidic ductile iron has a matrix which includes graphite nodules in a matrix of pearlite and carbides. The percent by volume of carbides in the matrix is 5-50%. The as-cast carbidic ductile iron preferably also includes an iron carbide-stabilizing element, a spheroidizing agent, and nickel. The matrix of the as-cast carbidic ductile iron may also include ferrite.

According to another aspect of the present invention, an as-cast ductile iron includes from 2.5 to 4% by weight of carbon, from 0.1 to 1.5% by weight of a carbide stabilizing element, from 0.02-0.06% by weight of a spheroidizing agent, and a matrix including pearlite and carbides, wherein the carbide % is 10 to 50% by volume. The as-cast carbidic ductile iron preferably also includes 0.25-1% by weight nickel and less than 2% by weight silicon.

According to another aspect of the present invention, a method for manufacturing as-cast carbidic ductile iron without an austempering step is provided. The as-cast carbidic ductile iron includes graphite nodules in a matrix comprising pearlite and 10-50% by volume of carbides. The as-cast carbidic ductile iron preferably also includes an iron carbide-stabilizing element, a spheroidizing agent, and nickel.

According to another aspect of the present invention, an as-cast carbidic ductile iron plow point is provided. The as-cast carbidic ductile iron plow point includes graphite nodules in a matrix structure obtained without an austempering treatment, wherein the matrix includes 3.5-3.9% by weight carbon, 0-2% by weight silicon, 0.35-0.45% by weight chromium, 0.4-0.6% by weight nickel, 0.45-0.55% by weight copper, 0.035-0.05% by weight magnesium, and the balance including iron.

DETAILED DESCRIPTION OF THE INVENTION

As set forth above, this invention relates to an as-cast carbidic ductile iron useful for high wear and abrasion resistant applications. The present inventor has surprisingly discovered that an as-cast ductile iron having a matrix of pearlite and 5-50% by volume of carbides has a high wear and abrasion resistance and, advantageously, may be produced without a time and cost intensive austempering heat process. In the preferred embodiment, the as-cast carbidic ductile iron of the invention not only provides wear and abrasion resistance, but also has good strength and toughness properties.

In one embodiment of the present invention, the as-cast carbidic ductile iron has a matrix which includes pearlite. Pearlite is a lamellar mixture containing ferrite and cementite. In another embodiment, the matrix may also include some amount of ferrite. The matrix of the as-cast ductile iron of the present invention also includes 5-50% by volume of carbides. The carbides provide the as-cast ductile iron of the present invention with high wear and abrasion resistance.

Figure 1:
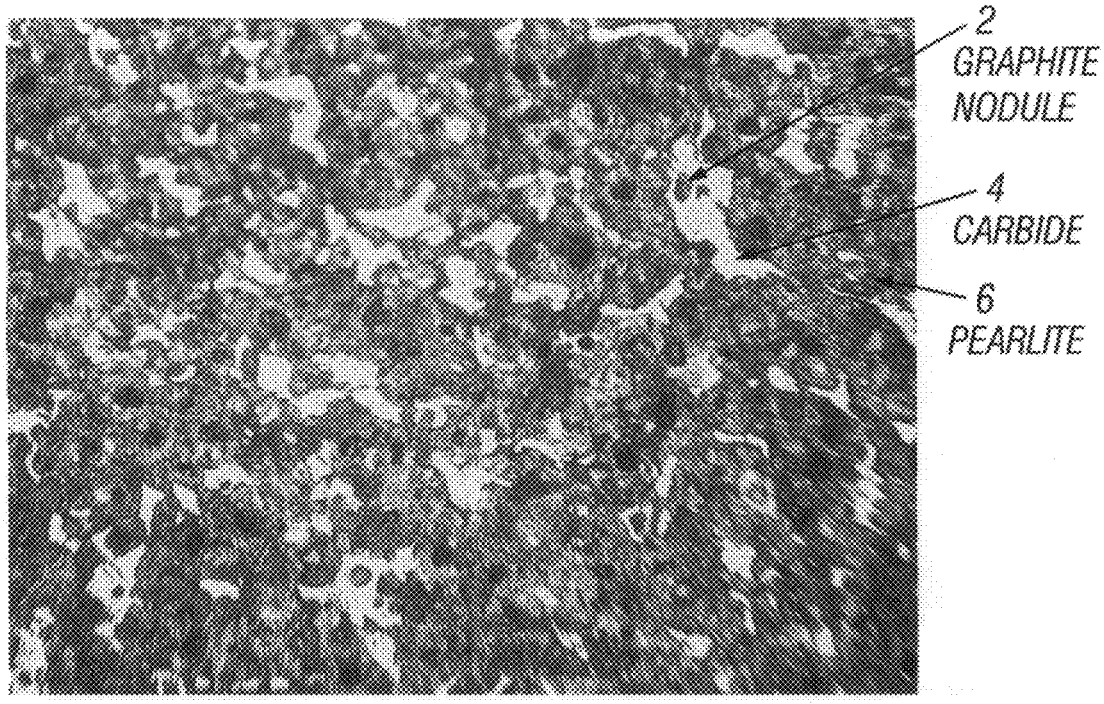
FIG. 1 is a photomicrograph of as-cast carbidic ductile iron according to one embodiment of the present invention.

FIG. 1 illustrates the matrix of one embodiment of the present invention. The matrix includes graphite nodules 2 surrounded by carbides 4. The matrix includes 10-15% by volume carbides 4. The balance of the matrix also includes pearlite 6.

Figure 2:
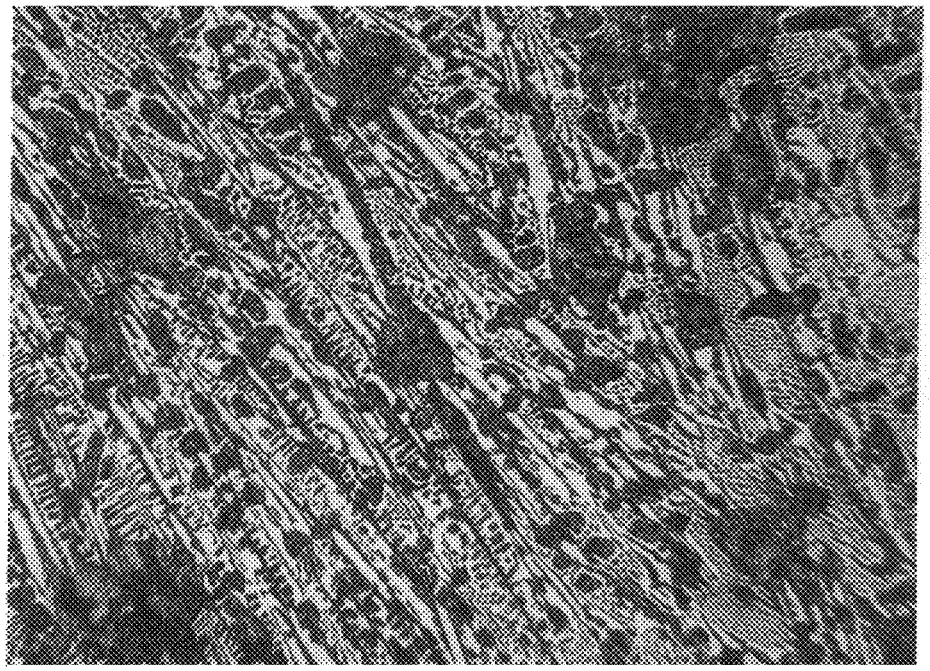
FIG. 2 is a photomicrograph of as-cast carbidic ductile iron according to one embodiment of the present invention.

FIG. 2 illustrates the matrix of another embodiment of the present invention. The matrix includes graphite nodules, 30-35% by volume carbides, and pearlite.

The percent carbide present in the as-cast carbidic ductile iron of the present invention is preferably achieved through control of the base iron chemistry and adding alloys to the iron. In one aspect of the present invention, carbide stabilizing elements are preferably added to the ductile iron to control the percentage of carbides present in the ductile iron. Carbide stabilizing elements preferentially combine with the carbon present in the ductile iron to form carbides. The carbide stabilizing element may be any suitable carbide stabilizing element known in the art, such as chromium, copper, boron, molybdenum, vanadium, and manganese.

Preferred carbide stabilizing elements are those elements which increase the amount of carbides present in the ductile iron. The preferred carbide stabilizing elements include chromium and copper. The preferred compositions of this invention will generally contain about 0.1-1.5% by weight of chromium and 0.1-0.8% by weight of copper. For plow tip points manufactured from the as-cast carbidic ductile iron of the present invention, the composition preferably includes 0.35-0.45% by weight of chromium and 0.45-0.55% by weight of copper.

The compositions of one embodiment of the present invention also include graphite spheroidizing agents. Graphite spheroidizing agents cause the shape of the graphite which precipitates during solidification of the iron to change from flakes to a spheroidal, or nodular, form. The spheroidal or nodular shaped precipitated graphite gives the preferred embodiment of the as-cast carbidic ductile iron of the present invention greater strength and ductility than conventional grey iron. Suitable graphite spheroidizing agents for use with the present invention may be any graphite spheroidizing agent known in the art, such as magnesium, cerium, calcium, or other rare earth elements which are commonly used in nodularizing treatments. The term "nodularizing treatment" as used herein includes the use of graphite spheroidizing agents to cause the precipitated graphite to have a spherical shape.

The preferred graphite spheroidizing agent for use with the preferred embodiment of the present invention is magnesium. In one aspect of the present invention, the as-cast ductile iron will generally contain about 0.02%-0.06% by weight magnesium with about 0.035%-0.05% by weight being preferred in plow tip points manufactured from the as-cast carbidic ductile iron of the present invention. Nickel-magnesium is preferably used as a carrier for the graphite spheroidizing agent magnesium. Nickel additionally improves the strength and the toughness of the ductile iron. In another embodiment of the present invention, treatment process with a more concentrated magnesium alloy well known to those of skill in the art are utilized, such as plunging, cored wire, or the tilting reactor method. In this embodiment, nickel is not utilized as the carrier for magnesium.

In another aspect of the present invention, the as-cast ductile iron includes a limited amount of silicon. In ductile iron, silicon acts such that the formation of carbides is suppressed. The preferred compositions of this invention will generally contain less than 2% by weight of silicon.

The as-cast carbidic ductile iron of the present invention may be manufactured in many different ways as desired. According to one aspect of the present invention, the as-cast ductile iron is manufactured using a modified pressure-sealed ductile iron treating ladle, also known as the teapot (or modified tundish) ladle. The metal is poured into the treatment ladle through the enlarged opening of the teapot spout. The cover cap is then closed and clamped shut in order to allow the nodularizing treatment to occur. Manufacturing processes used in the formation of as-cast ductile irons, such as the modified pressure-sealed ductile iron treating ladle, are well known to those of skill in the art. Other manufacturing processes, known to those of skill in the art, may also be used in the formation and manufacturing of the as-cast carbidic ductile iron of the present invention.

The carbide stabilizing element present in the preferred embodiment of the present invention may be added to the as-cast carbidic ductile iron of the present invention when the iron is transferred from the treatment ladle to the pouring ladle or prior to the nodularizing treatment, in either the melting furnace or the holding furnace. Preferably, the carbide stabilizing element is introduced by melting the ductile iron and adding the carbide stabilizing element, preferably with the graphite spheroidizing agent, to the treatment pocket in the treatment ladle. Other methods of introducing the carbide stabilizing element, known to those of skill in the art, may also be used in the formation and manufacturing of the as-cast carbidic ductile iron of the present invention.

The graphite spheroidizing agents present in the preferred embodiment of the present invention preferably are introduced by melting the iron and adding the graphite spheroidizing agent, preferably with the carbide stabilizing element, to the treatment pocket in the treatment ladle. Other methods of introducing the graphite spheroidizing agent, known to those of skill in the art, may also be used in the formation and manufacturing of the as-cast carbidic ductile iron of the present invention.

The as-cast carbidic ductile iron of the present invention has multiple different applications and uses. In one embodiment of the present invention, the as-cast carbidic iron is used in areas and fields where high abrasion and sliding wear resistance is desired. Typical areas and fields where high abrasion and sliding wear resistant ductile iron is desired includes, but is not limited to, mining applications, construction applications, such as a back hoe, and agricultural applications, such as disking and plowing.

Plow points require good wear and abrasion resistance since they are subjected to high friction forces in an abrasive environment. In addition to resistance to wear, a certain amount of toughness is also desirable for those times when a rock is struck by the plow point. As used herein, "toughness" means resistance to impact. Strength, toughness, and wear resistance are some of the material properties that must be balanced along with production cost in the manufacturing of plow points.

In one embodiment of the present invention, as-cast carbidic ductile iron plow points are provided. Plow points made from one embodiment of the as-cast carbidic ductile iron of the present invention are particularly advantageous. The as-cast carbidic ductile iron plow points of the present invention have high sliding wear and abrasion resistance, good toughness and strength properties, and are manufactured without an austempering process, saving time and money.

In another embodiment of the present invention, tungsten carbide is cast on to the tip of the as-cast carbidic ductile iron plow points. An appendage is affixed to the bottom of the tungsten carbide and the appendage and tungsten carbide are then placed in the casting mold. The as-cast carbidic ductile iron is then poured into the mold and solidifies around the appendage, holding the tungsten carbide in place.

The following examples are offered to illustrate but not limit the invention. Thus, they are presented with the understanding that various formulation modifications as well as method of delivery modifications may be made and still be within the spirit of the invention.

Example 1

As-Cast Carbidic Ductile Iron Formulation

In one embodiment of the present invention, an as-cast carbidic ductile iron containing iron nodules in a matrix of 5-50% by volume of iron and/or chromium carbides with the balance comprised of pearlite and/or ferrite. The percent range by weight of the elements in the composition of the embodiment is:

TABLE 1

| Element | Percent Range by Weight |
|---|---|
| Carbon | 2.5-4.0% |
| Silicon | <2.0% |
| Manganese | 0.1-1.0% |
| Chromium | 0.10-1.50% |

TABLE 1-continued

| Element | Percent Range by Weight |
|---|---|
| Nickel | 0.25-1.0% |
| Copper | 0.10-0.80% |
| Magnesium | 0.020-0.060% |

The preferred range of the elements listed above may vary depending on how much carbide is desired, the section size of the casting, and the cooling rate of the casting, which is dependant on the section size of the casting and the rate of heat extraction by the molding medium.

Example 2

As-Cast Carbidic Ductile Iron Plow Point Formulation

The formulation of another embodiment of the as-cast carbidic ductile iron of the present invention is presented. The formulations present in Example 2 are preferably used for manufacturing plow points. This embodiment of the as-cast carbidic ductile iron contains iron nodules in a matrix of 5-50% by volume of iron and/or chromium carbides with the balance comprised of pearlite and/or ferrite. The percent range by weight of the elements in the composition of the embodiment is:

TABLE 2

| Element | Percent Range by Weight |
|---|---|
| Carbon | 3.5-3.9% |
| Silicon | <2.0% |
| Manganese | 0.1-0.4% |
| Chromium | 0.35-0.45% |
| Nickel | 0.4-0.6% |
| Copper | 0.45-0.55% |
| Magnesium | 0.035-0.050% |

Example 3

As-Cast Carbidic Ductile Iron Plow Point Hardness Ranges

The hardness of one embodiment of the as-cast carbidic ductile iron plow points is presented. The hardness of the plow points is compared to ductile iron, austempered ductile iron, white iron, and carbidic austempered ductile iron.

TABLE 3

| Material | Grade | Typical Hardness Range |
|---|---|---|
| As Cast Carbidic Ductile Iron | Plow Points | 444-555 |
| Ductile Iron | ASTM A536, 65-45-12 | 156-217 HBW |
| | ASTM A536, 80-55-06 | 187-255 HBW |
| | ASTM A536, 100-70-03 | 241-302 HBW |
| Austempered Ductile Iron | ASTM A897, 125/80/10 | 269-321 HBW |
| | ASTM A897, 150/100/7 | 302-363 HBW |
| | ASTM A897, 175/125/4 | 341-444 HBW |
| | ASTM A897, 200/155/1 | 388-477 HBW |
| | ASTM A897, 235/185/— | 444-555 HBW |
| White Iron | Unalloyed | 350-550 HBW |
| | Alloyed | 500-700 HBW |
| CADI | Various | 331-564 HBW |

It is therefore evident that the present invention achieves the goal of providing a composition that provides increased wear and abrasion resistance, toughness and strength without the requirement of an austempering heat treatment step, as described above.

It should be appreciated that minor dosage and formulation modifications of the composition and the ranges expressed herein may be made and still come within the scope and spirit of the present invention.

Having described the invention with reference to particular compositions, theories of effectiveness, and the like, it will be apparent to those of skill in the art that it is not intended that the invention be limited by such illustrative embodiments or mechanisms, and that modifications can be made without departing from the scope or spirit of the invention, as defined by the appended claims. It is intended that all such obvious modifications and variations be included within the scope of the present invention as defined in the appended claims. The claims are meant to cover the claimed components and steps in any sequence which is effective to meet the objectives there intended, unless the context specifically indicates to the contrary.

The invention claimed is:

1. An as-cast ductile iron composition comprising:

from 2.5 to 4% by weight of carbon;

from 0.1 to 1.5% by weight of copper;

from 0.35 to 0.45% by weight of a carbide stabilizing agent;

less than 2% by weight of silicon;

from 0.02 to 0.06% by weight of magnesium; and a matrix structure obtained without an austempering treatment, wherein the matrix structure comprises pearlite and carbides, wherein the carbide % is 5-50% by volume of carbides and the balance is iron, and wherein the as-cast ductile iron has a hardness range of 444-555 HBW.

2. The as-cast ductile iron composition of claim 1, wherein the iron carbide stabilizing agent is selected from a set of iron carbide stabilizing agents, the set of iron carbide stabilizing agents comprising chromium, boron, molybdenum, vanadium, and manganese.

3. The as-cast ductile iron composition of claim 1, wherein the matrix structure further comprises ferrite.

4. The as-cast ductile iron composition of claim 1, further comprising a spheroidizing agent selected from a group consisting of cerium, and calcium.

5. The as-cast ductile iron composition of claim 1, further comprising nickel.

6. An object comprising the as-cast ductile iron composition of claim 1.

7. The object of claim 6, wherein said object is a plow point.

8. The as-cast carbidic ductile iron of claim 1, wherein the carbide stabilizing agent comprises 0.1-4% by weight manganese.

9. The as-cast carbidic ductile iron of claim 5, further comprising 0.25-1% by weight nickel.

10. The as-cast carbidic ductile iron of claim 1, wherein the as-cast ductile iron composition comprises 0.1-0.8% by weight copper.

11. The as-cast carbidic ductile iron of claim 1, wherein the carbide stabilizing agent comprises 0.35-0.45% by weight chromium.

12. A method of making an as-cast carbidic ductile iron composition comprising:

producing the as-cast ductile iron composition without an austempering treatment, wherein the as-cast-ductile iron composition comprises from 2.5 to 4% by weight of carbon; from 0.1 to 1.5% by weight of copper; from 0.02-0.06% by weight of magnesium; from 0.35 to 0.45% by weight of a carbide stabilizing agent; less than 2% by weight of silicon; and graphite nodules in a matrix structure obtained without an austempering treatment, wherein the matrix structure comprises pearlite and carbides, wherein the carbide % is 5-50% by volume of carbides and the balance is iron, and wherein the as-cast ductile iron has a hardness range of 444-555 HBW.

13. The method of claim 12, wherein the carbide stabilizing agent is selected from a set of iron carbide stabilizing agents, the set of iron carbide stabilizing agents comprising chromium, boron, molybdenum, vanadium, and manganese.

14. The method of claim 12, wherein the matrix structure further comprises ferrite.

15. The method of claim 12, further comprising a spheroidizing agent selected from a group consisting of cerium, and calcium.

16. The method of claim 12, further comprising nickel.

17. An as-cast carbidic ductile iron plow point comprising:

3.5-3.9% by weight carbon;

0-2% by weight silicon;

0.35-0.45% by weight chromium;

0.4-0.6% by weight nickel;

0.45-0.55% by weight copper;

0.035-0.05% by weight magnesium; and graphite nodules in a matrix comprising pearlite and carbides, wherein the carbide % is 5% to 50% by volume, and wherein the as-cast ductile iron has a hardness range of 444-555 HBW.

18. The as-cast carbidic ductile iron plow point of claim 17, wherein the matrix further comprises ferrite.

19. The as-cast carbidic ductile iron plow point of claim 17, further comprising tungsten carbide attached to the as-cast carbidic ductile iron plow point.

20. The as-cast ductile iron composition of claim 1 wherein the carbide stabilizing agent is chromium.

21. The method of claim 12 wherein the carbide stabilizing agent is chromium.

* * * * *